US011149734B2

(12) United States Patent
Chiba et al.

(10) Patent No.: US 11,149,734 B2
(45) Date of Patent: Oct. 19, 2021

(54) FLUID MACHINE

(71) Applicant: Hitachi Industrial Equipment Systems Co., Ltd., Tokyo (JP)

(72) Inventors: Kotaro Chiba, Tokyo (JP); Masahiko Takano, Tokyo (JP); Toshikazu Harashima, Tokyo (JP); Kosuke Sadakata, Tokyo (JP); Kentaro Yamamoto, Tokyo (JP); Takeshi Tsuchiya, Tokyo (JP); Masanao Kotani, Tokyo (JP); Ryoji Kawai, Tokyo (JP); Minako Kanada, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 167 days.

(21) Appl. No.: 16/323,595

(22) PCT Filed: Aug. 22, 2017

(86) PCT No.: PCT/JP2017/029851
§ 371 (c)(1),
(2) Date: Feb. 6, 2019

(87) PCT Pub. No.: WO2018/038070
PCT Pub. Date: Mar. 1, 2018

(65) Prior Publication Data

US 2019/0170143 A1 Jun. 6, 2019

(30) Foreign Application Priority Data

Aug. 23, 2016 (JP) ..... JP2016-162709

(51) Int. Cl.
*F01C 1/16* (2006.01)
*F03C 2/00* (2006.01)
(Continued)

(52) U.S. Cl.
CPC ..... *F04C 18/16* (2013.01); *F04C 29/0007* (2013.01); *F04C 29/023* (2013.01);
(Continued)

(58) Field of Classification Search
CPC .. F04C 18/16; F04C 29/0007; F04C 29/0014; F04C 29/023; F04C 29/028; F04C 29/042; F04C 2250/20; F05B 2260/98
See application file for complete search history.

(56) References Cited

U.S. PATENT DOCUMENTS 3,241,744 A * 3/1966 Schibbye ..... F04C 18/16 418/201.1
3,820,923 A 6/1974 Zweifel
(Continued)

FOREIGN PATENT DOCUMENTS

EP 1 666 729 A1 6/2006
GB 1196846 A 7/1970
(Continued)

OTHER PUBLICATIONS

JP06-047666A—Satou et al.—Underwater Nozzle for Reinforcement Metal—Feb. 22, 1994- English Machine Translation—(Year: 1994).*

(Continued)

*Primary Examiner* — Theresa Trieu
(74) *Attorney, Agent, or Firm* — Crowell & Moring LLP

(57) ABSTRACT

Provided is a fluid machine configured such that liquid supplied to a working chamber from the outside of the fluid machine is dispersed extensively in the working chamber. This fluid machine is constituted of a screw rotor and a casing for accommodating the screw rotor and is provided with a liquid supply section for supplying liquid into a working chamber from the outside. The liquid supply section is configured so that liquid is dispersed in the longitu-
(Continued)

dinal direction of the tooth groove of the screw rotor rather than in the width direction thereof.

6 Claims, 8 Drawing Sheets

(51) Int. Cl.

| | |
|---|---|
| ***F03C 4/00*** | (2006.01) |
| ***F04C 2/00*** | (2006.01) |
| ***F04C 18/16*** | (2006.01) |
| ***F04C 29/00*** | (2006.01) |
| ***F04C 29/04*** | (2006.01) |
| ***F04C 29/02*** | (2006.01) |

(52) U.S. Cl.
CPC ..... *F04C 29/028* (2013.01); *F04C 29/042* (2013.01); *F04C 2250/20* (2013.01); *F05B 2260/98* (2013.01)

(56) References Cited

U.S. PATENT DOCUMENTS

| | | | | |
|---|---|---|---|---|
| 4,273,287 | A | 6/1981 | Huber | |
| 4,497,185 | A * | 2/1985 | Shaw | F04C 29/042 418/99 |
| 5,653,585 | A * | 8/1997 | Fresco | F04C 29/042 418/99 |
| 2006/0285966 | A1 | 12/2006 | Gotoh et al. | |

FOREIGN PATENT DOCUMENTS

| | | | |
|---|---|---|---|
| JP | 52-135407 | A | 11/1977 |
| JP | 55-44394 | A | 3/1980 |
| JP | 56-53112 | B2 | 12/1981 |
| JP | 4-65146 | U | 6/1992 |
| JP | 6-47666 | A | 2/1994 |
| JP | 8-71454 | A | 3/1996 |
| JP | 2003-184768 | A | 7/2003 |
| JP | 2005-83260 | A | 3/2005 |

OTHER PUBLICATIONS

JP2003-184768A—Saito et al.—Water Jet Type Screw Compressor—Jul. 3, 2003—English Machine Translation (Year: 2003).*

International Search Report (PCT/ISA/210) issued in PCT Application No. PCT/JP2017/029851 dated Nov. 7, 2017 with English translation (five (5) pages).

Japanese-language Written Opinion (PCT/ISA/237) issued in PCT Application No. PCT/JP2017/029851 dated Nov. 7, 2017 (four (4) pages).

Extended European Search Report issued in counterpart European Application No. 17843550.9 dated Dec. 2, 2019 (seven pages).

Japanese-language Office Action issued in Japanese Application No. 2020-114275 dated Jun. 1, 2021 with English translation (six (6) pages).

* cited by examiner

FLUID MACHINE

TECHNICAL FIELD

The present invention relates to a fluid machine having a function of supplying liquid to the inside of a compression chamber from the outside.

BACKGROUND ART

As a screw compressor, there is a screw compressor that has a function of supplying liquid from the outside to the inside of the compression chamber. The purpose of liquid supply is to seal an internal clearance, cool the gas in the compression process, lubricate sliding both female and male rotors, and the like.

As a device that injects liquid into the compressor, there is Patent Document 1. Patent Document 1 discloses "A water supply section is formed on a wall surface portion of a casing corresponding to a compression working chamber. . . . A plurality of small holes communicating with the outside by being inclined by an angle θ is formed at a bottom of the water supply member. . . . Water guided to a blocked hole is injected from the small hole to the compression working chamber over a wide range (Paragraphs 0020, 0021)."

CITATION LIST

Patent Document

Patent Document 1: JP 2003-184768 A

SUMMARY OF THE INVENTION

Problems to be Solved by the Invention

A "water injection type screw compressor" described in Patent Document 1 has a water supply section having a plurality of small holes inclined by an angle θ, and discloses that the water injected from the small holes is dispersed inside the compression working chamber in a wide range. Water injected from a plurality of inclined small holes is dispersed after colliding with each other, but a direction thereof has directivity. That is, there is a characteristic that the water is hard to disperse in a straight line direction connecting the small holes, and the water easily is dispersed in a direction orthogonal to the straight line direction. On the other hand, the compression working chamber of the screw compressor has a V-shaped groove shape wrapped around both female and male rotors. In order to disperse water in a wide range of the compression working chamber, it is necessary to disperse water in a longitudinal direction of the grooves of both the female and male rotors. However, in Patent Document 1, the directivity of dispersion of water injected from the water supply section has not been taken into consideration.

An object of the present invention is to disperse the liquid supplied to the working chamber from the outside of the fluid machine in a wide range of the working chamber.

Solutions to Problems

In order to achieve the above object, as an example of the "fluid machine" of the present invention, there is provided a fluid machine which is formed by a screw rotor and a casing for accommodating the screw rotor, and includes a liquid supply section for supplying liquid into a working chamber from the outside, in which the liquid supply section is configured to disperse the liquid in a longitudinal direction rather than a width direction of a groove of the screw rotor.

Effects of the Invention

According to the present invention, since the liquid supplied to the working chamber from the outside of the fluid machine is dispersed in a wide range along the groove of the screw rotor, a heat transfer region between the compressed gas and liquid expands, the cooling effect of the compressed gas due to the liquid can be promoted, and the compression power can be reduced.

Further, since the liquid is dispersed in a wide range of the working chamber, the liquid is sealed over a wide range of a clearance between a leading end of the male rotor and a male side bore, or between a leading end of the female rotor and a female side bore, and the compression efficiency can be improved. This enables energy saving of the fluid machine.

MODE FOR CARRYING OUT THE INVENTION

In the following examples, a twin screw air compressor which has two rotors and compresses air will be described as an example of a fluid machine, but it can be modified within the scope that does not change the gist of the present invention. That is, the present invention is also applicable to other fluid machines, for example, a single screw compressor and a compressor having three or more rotors such as a triple screw compressor, and the gas to be compressed may be other than air.

Prior to describing the example, the overall configuration of the screw compressor will be described.

Figure 8:
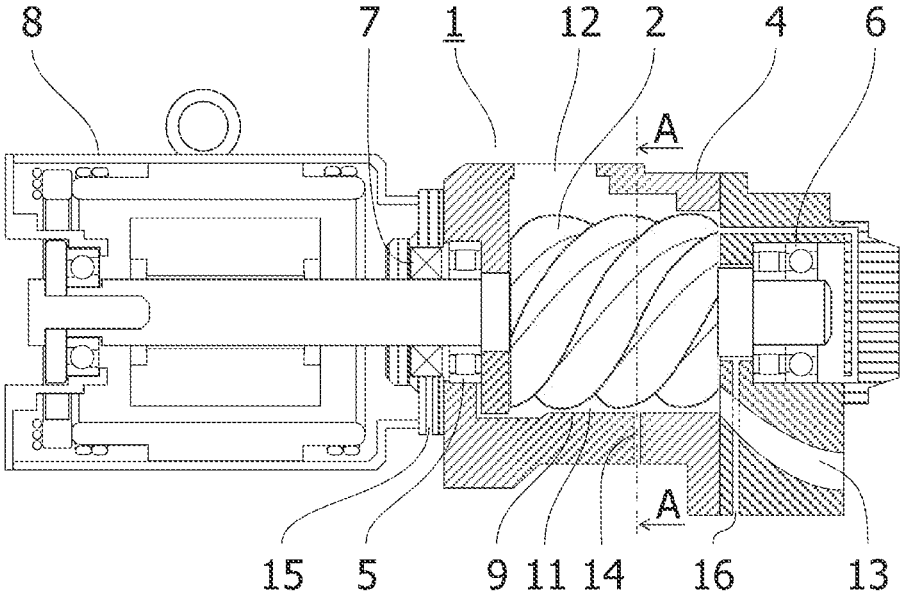
FIG. 8 PRIOR ART
FIG. 8 is a configuration diagram of a general screw compressor.
Figure 9:
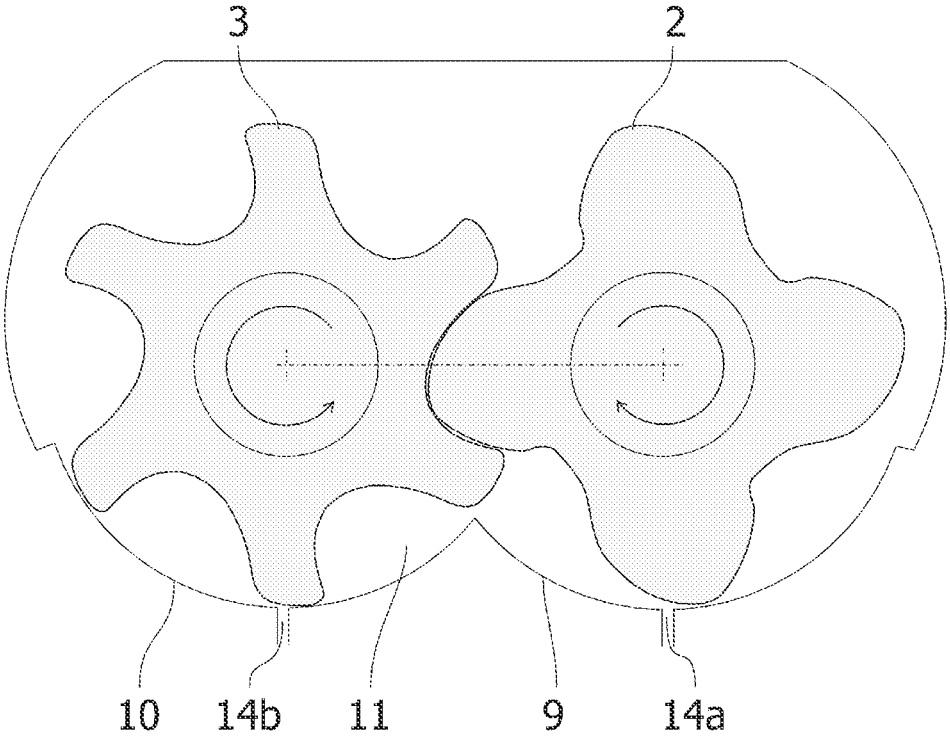
FIG. 9 PRIOR ART
FIG. 9 is a cross-sectional view taken along line A-A of FIG. 8.

FIGS. 8 and 9 illustrate the configuration of the screw compressor. FIG. 8 is a configuration diagram of the screw compressor, and FIG. 9 is a cross-sectional view taken along the line A-A of FIG. 8. A screw compressor 1 includes a male rotor 2 and a female rotor 3 which have twisted teeth (lobes) and rotate while meshing with each other, a casing 4 accommodating the female and male rotors, a suction side bearing 5 and a delivery side bearing 6 for rotatably supporting both the female and male rotors, respectively, and a shaft sealing component 7 such as an oil seal or a mechanical seal. In general, the male rotor 2 is connected to a motor 8, which is a rotational driving source, via a rotor shaft at a suction side end portion. Further, the male rotor 2 and the female rotor 3 are accommodated in a male side bore 9 and a female side bore 10 of the casing 4, while maintaining a clearance of several tens to several hundreds of μm.

The male rotor 2 rotationally driven by the motor 8 rotationally drives the female rotor 3 so that a working chamber 11 formed by the grooves of both the female and male rotors and the male side bore 9 and the female side bore 10 surrounding the grooves is expanded and contracted, thereby sucking a fluid such as air from a suction port 12, compressing the fluid to a predetermined pressure, and then delivering the fluid from a delivery flow path 13. Further, liquid is injected with respect to the working chamber 11, the suction side bearing 5, the delivery side bearing 6, and the shaft sealing component 7 from the outside of the screw compressor 1 via a liquid supply hole 14, a suction side bearing liquid supply hole 15, and a delivery side bearing liquid supply hole 16. In FIG. 9, a reference sign 14*a* denotes a liquid supply hole of the male side bore, and a reference sign 14*b* denotes a liquid supply hole of the female side bore.

Figure 10:
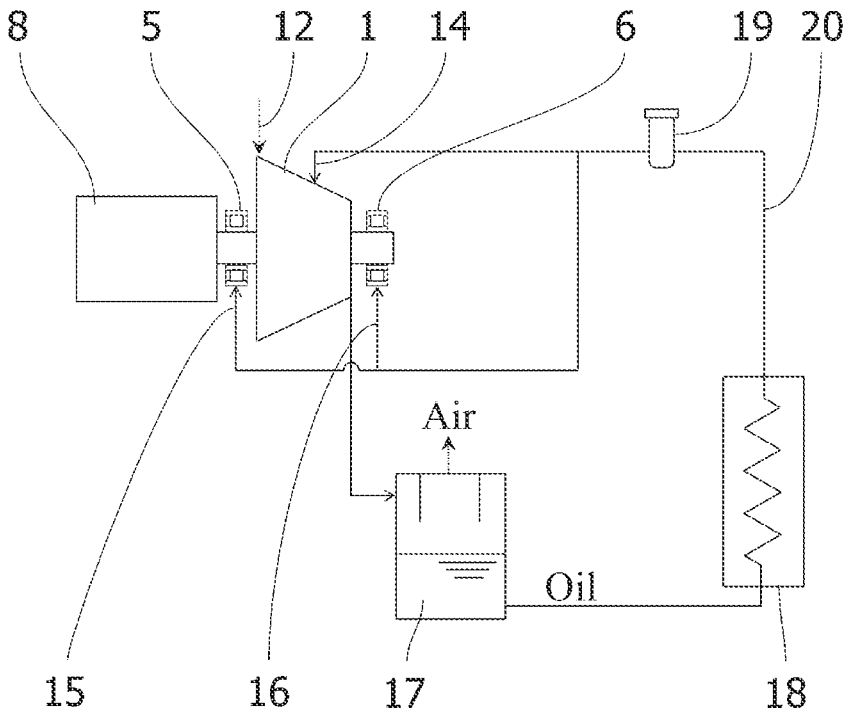
PRIOR ART FIG. 10
FIG. 10 is a view illustrating an oil supply path of a general screw compressor.

FIG. 10 illustrates an external path of the liquid which is supplied to the screw compressor 1. The liquid path is formed by the screw compressor 1, a centrifugal separator 17, a cooler 18, an auxiliary device 19 such as a filter or a backpressure valve, and a piping 20 for connecting these members. Liquid injected into the compressor from the outside is mixed in the compressed gas delivered from the screw compressor 1. The liquid mixed in the compressed gas is separated from the compressed gas by the centrifugal separator 17, and is cooled by the cooler 18. Thereafter, the liquid branches via the auxiliary device 19, and is supplied again from the liquid supply hole 14 into the working chamber 11 inside the screw compressor 1, from the suction side bearing liquid supply hole 15 to the suction side bearing 5, and from the delivery side bearing liquid supply hole 16 to the delivery side bearing 6. Further, a branching point of the liquid path is not limited to the outside of the screw compressor 1 as illustrated in the drawing, but also includes a branch inside the casing 4 of the screw compressor 1.

The present invention is to promote the cooling effect of the compressed gas or the like, by dispersing the liquid supplied to the working chamber 11 from the outside of the screw compressor in a wide range of the working chamber, in such a screw compressor.

Hereinafter, examples of the present invention will be described with reference to the drawings.

First Example

Figure 1A:
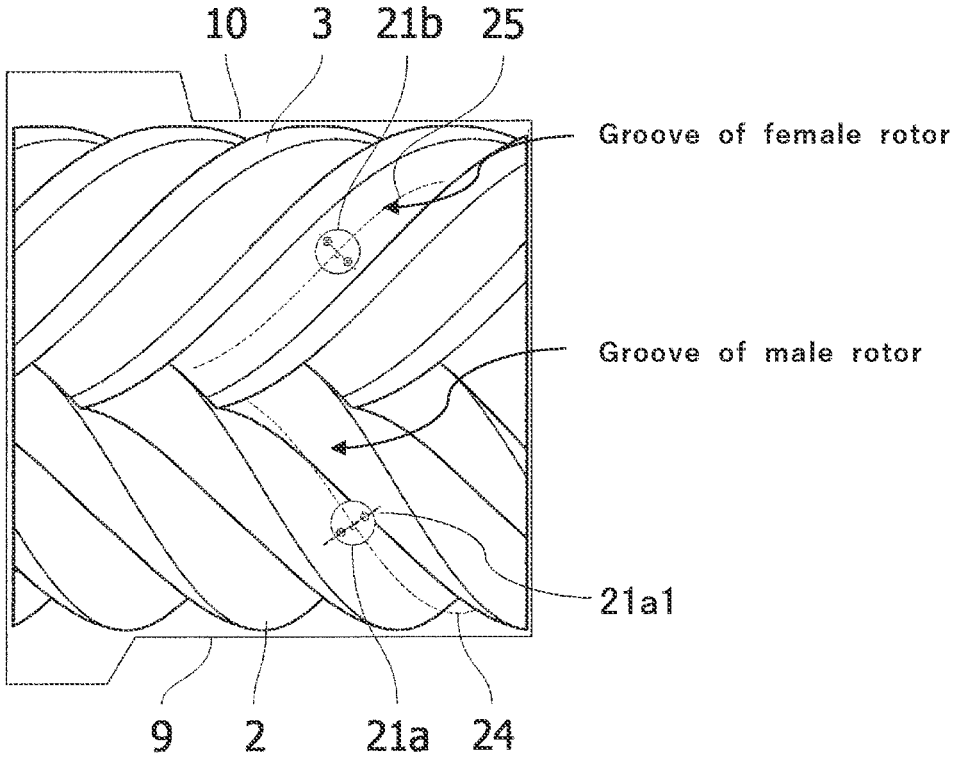
FIG. 1A is a rotor outer view of a screw compressor according to a first example of the present invention.
Figure 2:
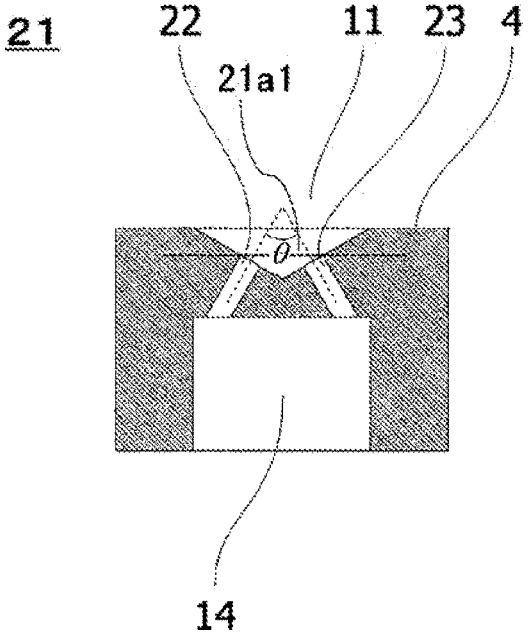
FIG. 2 is a cross-sectional view of a nozzle according to the first example of the present invention.

FIGS. 1A and 2 illustrate a first example of the present invention. Further, it should be noted that this example relates to a screw type air compressor which compresses air. In addition, since the configuration of the screw compressor illustrated in FIGS. 8 and 9 has the same configuration, the same reference numerals are given and description thereof will not be provided.

FIG. 2 is a cross-sectional view of a nozzle 21 of this example which is a liquid supply section provided between the liquid supply hole 14 and the working chamber 11 in the casing 4 of the screw compressor. This cross-sectional view illustrates a case where a cross section is taken in a radial direction from an outer peripheral surface of the bore to an inner peripheral surface along a straight line 21*a*1 (details thereof will be described later) of FIG. 1A. The nozzle 21 of the first example is referred to as an impinging jet nozzle. A first injection hole 22 and a second injection hole 23 having a smaller hole diameter than the liquid supply hole 14 are connected to the end portion of the liquid supply hole 14 so as to be inclined by an angle θ to each other, and the first injection hole 22 and the second injection hole 23 communicate with the working chamber 11. The first injection hole 22 and the second injection hole 23 intersect each other on the side of the working chamber 11, and the intersecting point is located on the groove of the screw rotor. Lubricating oil which flows into the first injection hole 22 and the second injection hole 23 from the liquid supply hole 14 and is injected from each of them collides with each other and then is dispersed. There is directivity in its dispersion direction, the lubricating oil is hard to disperse in the direction of the straight line for connecting the first injection hole 22 and the second injection hole 23, and the lubricating oil is easy to disperse in the direction orthogonal to the direction of the straight line. Further, the lubricating oil flowing out from the first injection hole 22 and the second injection port 23 is atomized and dispersed after collision. Further, the liquid to be supplied to the nozzle may be water.

FIG. 1A illustrates a male side nozzle 21*a* connected to the male side bore 9, and a female side nozzle 21*b* connected to the female side bore 10. In the male side nozzle 21*a*, the straight line 21*a*1 for connecting each of opening portions of the first injection hole 22 and the second injection hole 23 on the working chamber 11 side is installed to be orthogonal to a longitudinal direction 24 of the groove of the male rotor. Further, the straight line 21*a*1 is defined as a straight line for connecting not only the position illustrated in FIG. 2 but also central axes of the first injection hole 22 and the second injection hole 23 in the longitudinal direction. Since the lubricating oil injected from the male side nozzle 21*a* is widely dispersed in a direction orthogonal to the straight line for connecting the first injection hole 22 and the second injection hole 23, the lubricating oil is widely dispersed in the groove of the male rotor 2. Thus, a heat transfer region between the atomized lubricating oil and the compressed air widens, and cooling of the compressed air in the compression process is promoted, which leads to an improvement in compression efficiency. Further, since the lubricating oil is widely dispersed into the groove of the male rotor 2, the lubricating oil is present in a wide range of the clearance between the male rotor 2 and the male side bore 9, and the effect of suppressing the internal leak of the compressed air can be improved. For the same purpose, the female side nozzle 21*b* is also installed so that the straight line for connecting the first injection hole 22 and the second injection hole 23 is orthogonal to a longitudinal direction 25 of the groove of the female rotor 3. As a result, it is possible to achieve an energy-saving screw type air compressor with high compression efficiency and less internal leak.

Further, in this example, the straight line for connecting the first injection hole 22 and the second injection hole 23 of the male side nozzle 21*a* is orthogonal to the longitudinal direction 24 of the groove of the male rotor 2. However, when an angle falls within ±25° from the orthogonal direction, since a scattering range of the lubricating oil is 90% or more of a case where the straight line is orthogonal to the longitudinal direction, the cooling effect of compressed air and the effect of suppressing the internal leak do not change significantly. Therefore, the straight line for connecting the first injection hole 22 and the second injection hole 23 of the male side nozzle 21*a* does not need to be exactly orthogonal to the longitudinal direction 24 of the groove of the male rotor 2. The same also applies to the female side nozzle 21*b*.

Figure 1B:
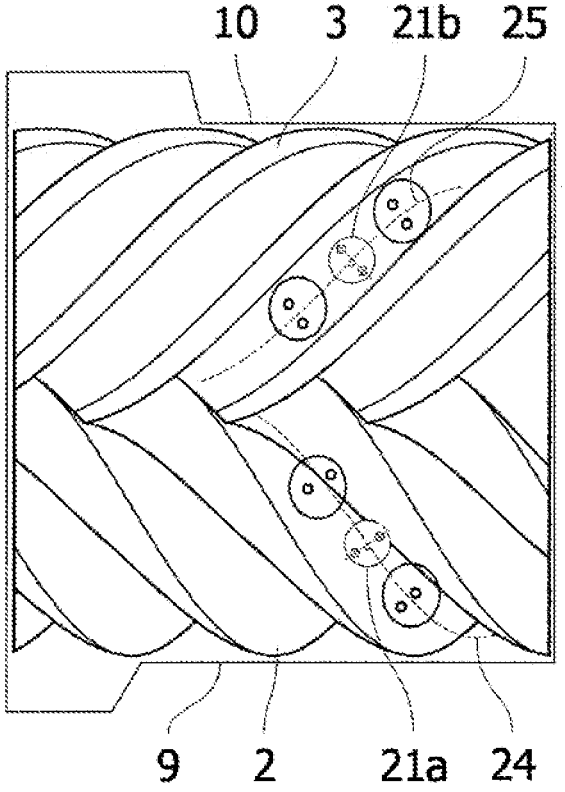
FIG. 1B is a rotor outer view of a screw compressor according to a modified example of the first example of the present invention.

FIG. 1B illustrates a rotor outer view of a screw compressor of a modified example of the first example. A plurality of (three) male type nozzles 21*a* and female type nozzles 21*b* are provided, respectively. A positional relation of the plurality of nozzles is preferably provided at a certain interval so that the atomized lubricating oils generated from the adjacent nozzles do not excessively collide with each other.

Second Example

Figure 3:
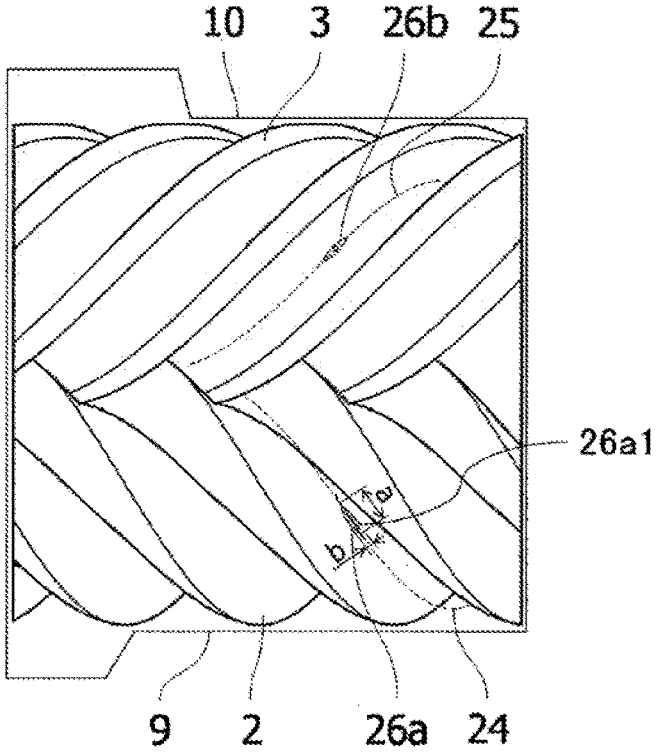
FIG. 3 is a rotor outer view of a screw compressor according to a second example of the present invention.
Figure 4:
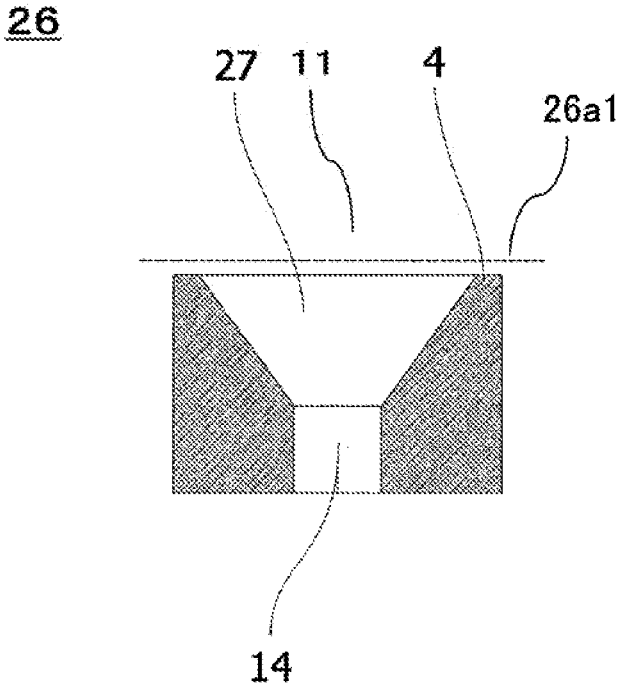
FIG. 4 is a cross-sectional view of a nozzle according to the second example of the present invention.
Figure 5:
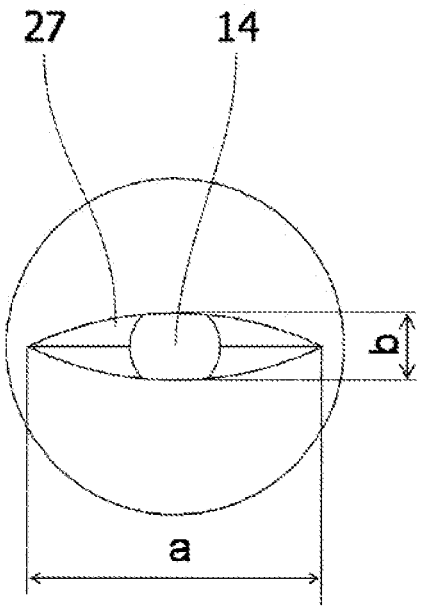
FIG. 5 is a view illustrating a connecting section between a slit section and a working chamber according to the second example of the present invention.

FIGS. 3, 4, and 5 illustrate a second example of the present invention. Further, this example relates to a screw type air compressor in the same manner as in the first example, and the same parts as those in the first example will be described by being denoted by the same reference numerals.

This example is different from the first example in that a male side nozzle 26*a* and a female side nozzle 26*b* having slit sections are provided in place of the male side nozzle 21*a* and the female side nozzle 21*b*. FIG. 4 illustrates a cross-sectional view of the nozzle 26 of the present example in the longitudinal direction of the slit section. The nozzle 26 of the second example is referred to as a fan spray nozzle. The lubricating oil flowing into the liquid supply hole 14 flows into the working chamber 11 via a slit section 27. The slit section 27 has such a shape that the cross-sectional area thereof increases from the connecting section with the liquid supply hole 14 to the connecting section with the working chamber 11. FIG. 5 illustrates the connecting section between the slit section 27 and the working chamber 11. The slit section 27 has a shape in which a dimension a in the longitudinal direction of the slit is longer than a dimension b in the width direction. The lubricating oil injected from the slit section 27 into the working chamber 11 is dispersed in the direction of the dimension a (the longitudinal direction of the slit) to be wider than in the direction of the dimension b (the width direction of the slit). The lubricating oil is injected in a film form from the slit section 27, and then is atomized.

As illustrated in FIG. 3, the male side nozzle 26*a* is arranged so that a straight line 26*a*1 indicating the dimension a in the longitudinal direction of the slit section 27 is located along the longitudinal direction 24 of the groove of the male rotor 2. Further, the straight line 26*a*1 may define not only the position illustrated in FIG. 4, but also a position which is in a parallel relation with this position. As a result, since the lubricating oil injected from the male side nozzle 26*a* is widely dispersed in the longitudinal direction of the slit section 27, the lubricating oil is widely dispersed into the groove of the male rotor 2. As a result, as in the first example, the cooling effect of the compressed air and the effect of reducing the internal leak are promoted. For the same purpose, the female side nozzle 26*b* is also installed so that a direction of the dimension a (the longitudinal direction of the slit) extends along the longitudinal direction 25 of the groove of the female rotor 3. Thus, it is possible to achieve an energy-saving screw type air compressor.

Further, in this example, the straight line 26*a*1 indicating the dimension a in the longitudinal direction of the slit section 27 is arranged in parallel along the longitudinal direction 24 of the groove of the male rotor 2. However, for the same reason as described in the first example, when the angle is within ±25° with respect to the longitudinal direction 24 of the groove of the male rotor 2, it is possible to achieve a dispersion range of lubricating oil of 90% or more as compared with a case where the straight line 26*a*1 is parallel to the longitudinal direction 24. Therefore, the dimension a in the longitudinal direction of the slit section 27 does not need to be exactly parallel to the longitudinal direction 24 of the groove of the male rotor 2. The same also applies to the female side nozzle 26*b*.

Third Example

Figure 6:
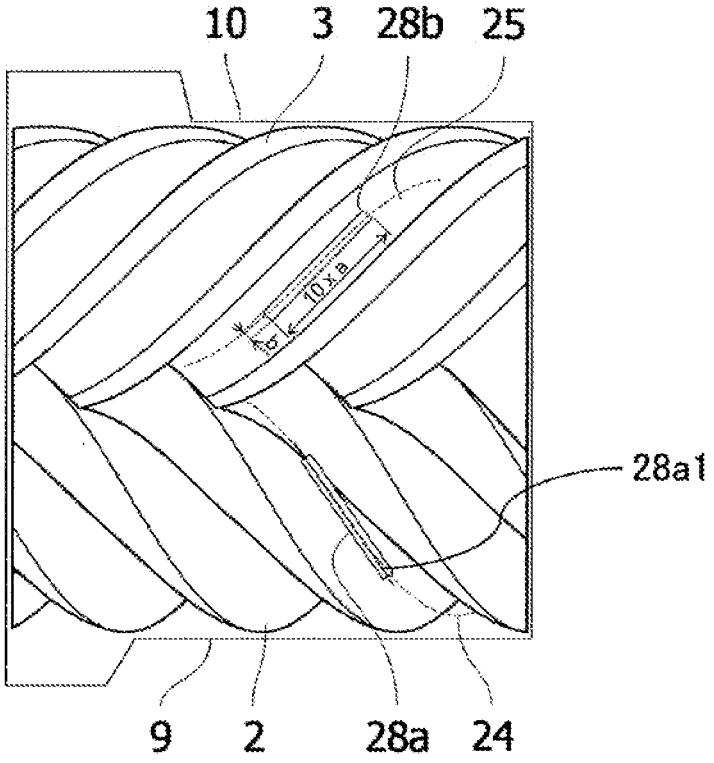
FIG. 6 is a rotor outer view of a screw compressor according to a third example of the present invention.
Figure 7:
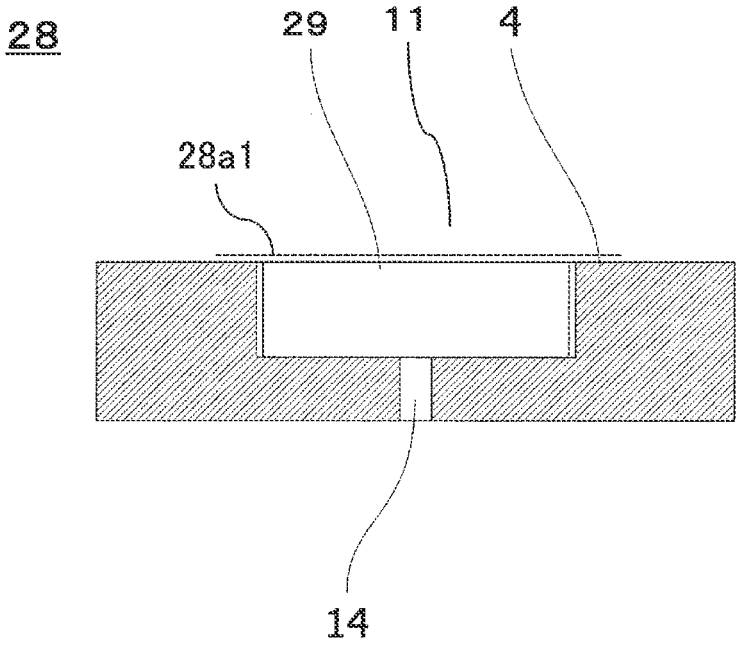
FIG. 7 is a cross-sectional view of a nozzle according to the third example of the present invention.

FIGS. 6 and 7 illustrate a third example of the present invention. Further, this example relates to a screw type air compressor in the same manner as in the second example, and the same parts as those of the second example will be described by being denoted by the same reference numerals.

This example is different from the second example in that the former includes a nozzle 28 in which a shape of a connecting section between the nozzle 26 and the working chamber 11 has a rectangular groove section 29 having a larger area of an opening portion. In this example, a dimension of a long side of the opening portion of the groove section 29, which is the connecting section between the nozzle 28 and the working chamber 11, is ten times that of the slit section 27 of the second example, and the dimension of a short side is approximately equal to that of the slit section 27.

As illustrated in FIG. 6, a nozzle 28*a* connected to the male rotor 2 is arranged so that the longitudinal direction 28*a*1 of the opening portion extends along the same or nearly the same direction as the longitudinal direction 24 of the groove of the male rotor 2 forming the working chamber 11. The same also applies to a nozzle 28*b* connected to the female rotor 3. Accordingly, since the opening area of the connecting section between the nozzle 28 and the working chamber 11 is large as compared with the nozzle 26 illustrated in the second example, the effect of atomization of the lubricating oil becomes small, but the lubricating oil is widely dispersed in a wider range of the groove of the male rotor 2 and the groove of the female rotor 3 that form the working chamber 11. Therefore, there is an effect of sealing the wider range of the clearance between the male rotor 2 and the male side bore 9 and the clearance between the female rotor 3 and the female side bore 10 with the lubricating oil, and it is possible to achieve a screw type air compressor which is small internal leak, that is, energy-saving.

Further, in each of the above-described examples, the present invention has been described by exemplifying a screw type air compressor for compressing the air, but the present invention can be applied to a general screw compressor for compressing a gas, without being limited to air. Further, although the screw compressor including a pair of male and female screw rotors has been described, the present invention can also be applied to a screw compressor of a single rotor or triple rotors.

As described in the above examples, in the screw compressor of the present invention, the nozzle serving as the liquid supply section is configured to disperse the liquid in the longitudinal direction rather than the width direction of the groove of the screw rotor.

As a result, since the liquid supplied to the working chamber from the outside of the screw compressor is dispersed in a wide range along the groove of the screw rotor, the heat transfer region between the compressed gas and the liquid expands, and the cooling effect of the compressed gas due to the liquid can be promoted and the compression power can be reduced. Further, since the liquid is dispersed in a wide range of the working chamber, the liquid is sealed over a wide range of the clearance between the leading end of the rotor and the bore, and the compression efficiency can be improved. Further, energy saving of the screw compressor can be achieved.

REFERENCE SIGNS LIST

1 Screw compressor
2 Male rotor
3 Female rotor
4 Casing
5 Suction side bearing
6 Delivery side bearing
7 Shaft sealing component
8 Motor
9 Male side bore
10 Female side bore
11 Working chamber
12 Suction port
13 Delivery flow path
14 Liquid supply hole
15 Suction side bearing liquid supply hole
16 Delivery side bearing liquid supply hole
17 Centrifugal separator
18 Cooler
19 Auxiliary device
20 Piping
21 Nozzle of first example
22 First injection hole
23 Second injection hole
24 Longitudinal direction of groove of male rotor 2
25 Longitudinal direction of groove of female rotor 3
26 Nozzle of second example
27 Slit section
28 Nozzle of third example
29 Groove section

The invention claimed is:

1. A fluid machine comprising:
a screw rotor;
a casing configured to accommodate the screw rotor; and
a liquid supply section configured to supply liquid into a working chamber from an outside of the casing, wherein
the liquid supply section includes a plurality of liquid injection holes in which each axis is inclined with respect to each other in a same plane and that intersects in a same groove of the screw rotor,
the liquid supply section is disposed such that a straight-line connecting center axes of the plurality of liquid injection holes in a longitudinal direction is at an angle that is within +/−25 degrees with respect to a direction orthogonal to the longitudinal direction of the groove of the screw rotor; and
the liquid supply section is configured to disperse the liquid in the longitudinal direction rather than a width direction of the groove of the screw rotor.

2. The fluid machine according to claim 1, wherein the liquid supply section is disposed in a direction in which the straight line is orthogonal to the longitudinal direction of the groove communicating with the liquid injection holes of the screw rotor.

3. The fluid machine according to claim 2, wherein the liquid supply section is an impinging jet nozzle.

4. The fluid machine according to claim 3, wherein a plurality of impinging jet nozzles are positioned at given intervals with respect to one another.

5. The fluid machine according to claim 1, wherein the liquid supply section is an impinging jet nozzle.

6. The fluid machine according to claim 5, further comprising a plurality of impinging jet nozzles are positioned at given intervals with respect to one another.

* * * * *